United States Patent [19]

Spera

[11] Patent Number: 4,805,879

[45] Date of Patent: Feb. 21, 1989

[54] HAND RAILING ASSEMBLY

[76] Inventor: Vittorio Spera, 7189 Liseaux Street, St. Leonard, Quebec, Canada, H1S 2G3

[21] Appl. No.: 130,638

[22] Filed: Dec. 9, 1987

[51] Int. Cl.[4] ..... E04H 17/14

[52] U.S. Cl. ..... 256/65; 256/22

[58] Field of Search ..... 256/65, 59, 22, 72

[56] References Cited

U.S. PATENT DOCUMENTS

| | | | |
|---|---|---|---|
| 3,522,933 | 8/1970 | Braun | 256/22 |
| 3,822,053 | 7/1974 | Daily | 256/22 |
| 3,924,834 | 12/1975 | Young | 256/22 |
| 3,973,756 | 8/1976 | Lauzier | 256/21 |
| 4,027,855 | 6/1977 | Lauzier | 256/21 |
| 4,334,671 | 6/1982 | DeGuise | 256/65 |
| 4,451,025 | 5/1984 | Spera | 256/65 |

FOREIGN PATENT DOCUMENTS

| | | |
|---|---|---|
| 967041 | 5/1975 | Canada . |
| 1090639 | 12/1980 | Canada . |

*Primary Examiner*—Andrew V. Kundrat

[57] ABSTRACT

A hand railing assembly for balconies, stairways and the like is supplied to a building site in kit form and is assembled by snap lock connections that have positive stops for increased rigidity. The improvement to a hand railing assembly with a stop rail and a bottom rail secured in spaced apart parallel relationship by a plurality of spaced apart vertical pickets, comprises each of the vertical pickets having a substantially H-shaped cross section with curved flanges and a center web, the top and bottom rails each having a first member and a second member, the first member extending for the length of the railing assembly and having pairs of slots spaced apart along the length, the pairs of slots holding the flanges at the ends of the pickets, the second member positioned in opposing grooves in the first member having a snap lock connection to notches located in the flanges at the ends of the pickets, and a first positive stop for the end of each of the flanges, the web of each of the pickets being cut out at the end of the pickets to provide a second positive stop with the first member between slots in each of the pairs of slots.

8 Claims, 5 Drawing Sheets

HAND RAILING ASSEMBLY

The present invention relates to a hand railing assembly for balconies, stairways and the like. More specifically, the present invention provides a light weight hand rail assembly with components that can be snap-locked together for ease of installation on site, and compact packaging of components for reduced shipping space.

There are many available types of hand railing assemblies, many of them made from extruded aluminum sections. In some cases they require pre-assembly before being shipped to site, or alternatively, are assembled on site by the use of special tools. In some cases, the railings are not rigid, but have some movement between components which in most circumstances is undesirable.

It is a purpose of the present invention to provide a hand railing assembly which has pickets that snap lock into place between a top and bottom rail and posts that snap lock to the top rail and are held to the bottom rail. Furthermore, it is an aim of the present invention to provide a hand railing assembly wherein each connection between the pickets and rails has at least two positive stops and at least one snap lock, thus providing increased rigidity for the railing assembly.

A still further aim of the present invention is to provide a hand railing assembly which does not have joints between inter-locking components that remain exposed to rain and dirt. Furthermore, the pickets, posts and rails can be snap locked together on site, thus reducing shipping space.

The present invention provides in a hand railing assembly with a top rail and a bottom rail secured in spaced apart parallel relationship by a plurality of spaced apart vertical pickets, the railing assembly being supported by a plurality of spaced apart vertical posts connected to the top rail, the improvement comprising each of the vertical pickets having a substantially H-shaped cross section with curved flanges and a center web, the top and bottom rails each having a first member and a second member, the first member extending for the length of the railing assembly and having pairs of slots spaced apart along the length, the pairs of slots holding the flanges at the ends of the pickets, the second member positioned in opposing grooves in the first member, having a snap lock connection to notches located in the flanges at the ends of the pickets, and a first positive stop for the end of each of the flanges, the web of each of the pickets being cut out at the ends of the pickets to provide a second positive stop with the first member between slots in each of the pairs of slots.

In other embodiments of the invention, the snap lock connection has two flexible flanges with detents to engage in the notches located either on the inside or the outside of the two flanges. Alternatively, the snap lock connection is a flexible member with two detents to engage in the notches located on the inside of the two flanges. The railing assembly preferably has a cover member snap locked to the first member of the top rail, and in another embodiment, the cover member is semi-circular and together with the first member form a circular cross section. In this case, cover members are provided on the top and bottom rail. In this embodiment, the vertical posts preferably have a circular cross section substantially the same size as the top and bottom rail.

In drawings which illustrate embodiments of the invention;

Figure 1:
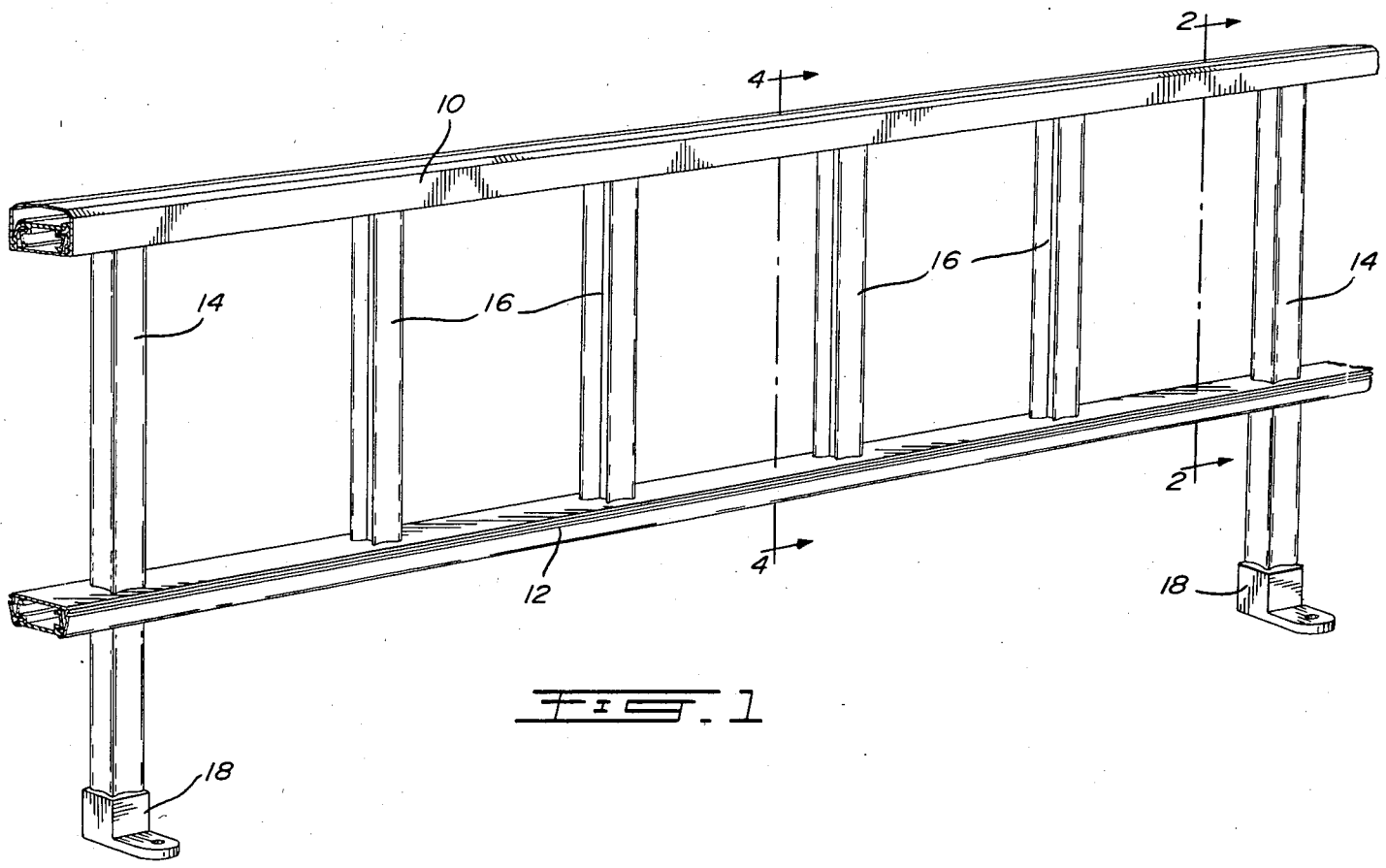
FIG. 1 is an isometric view of a hand railing assembly according to one embodiment of the present invention.

Referring to FIG. 1 one embodiment of a hand railing assembly is shown having a top rail 10 and a bottom rail 12, spaced apart in substantially parallel relationship. The hand railing assembly shows two posts 14 which support the railing assembly and four pickets 16 substantially evenly spaced apart between the posts 14. The pickets are connected to both the top rail 10 and the bottom rail 12 and hold them rigidly in position Mounting shoes 18 are provided at the bottom of the posts 14 to support the hand railing assembly.

Figure 2:
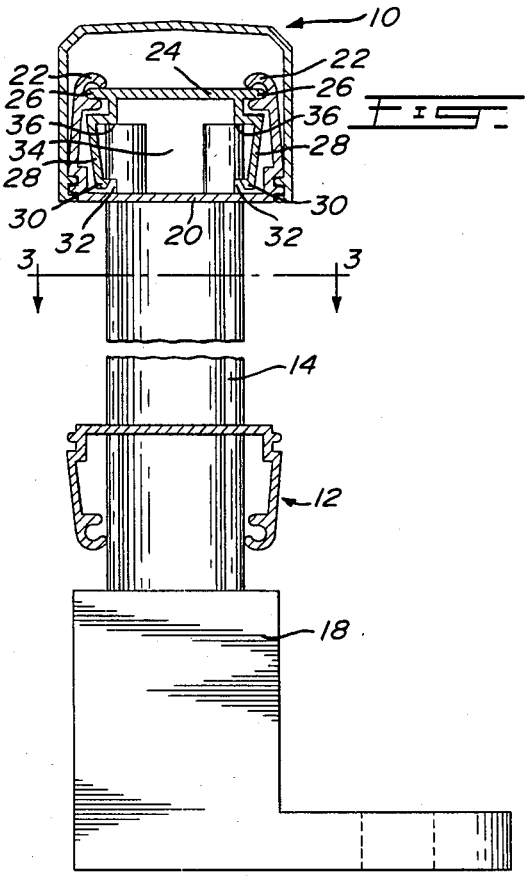
FIG. 2 is a cross sectional elevation taken at line 2—2 of FIG. 1.
Figure 3:
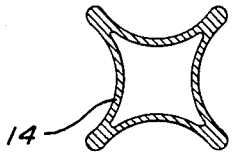
FIG. 3 is a cross section of the post taken at line 3—3 of FIG. 1.

A detail of the post assembly is shown in FIG. 2 wherein the post 14 which has a cross section as illustrated in FIG. 3, is snap locked to the top rail 10 and passes through a slot cut in the bottom rail 12. The top rail assembly 10 has a first channel shaped member 20 which is inverted and has grooves 22 opposing each other at the ends of the flanges of the inverted channel. Into these grooves 22 fits a second member 24 with protruding elements 26 on each side to slide in the grooves 22. The second member 24 has flanges 28 extending downwards with detents 30 at the end of each flange 28 to engage in notches 32 provided on the outside of the top end of the post 14. The flanges 28 of the second member 24 are flexible so that the post 14 may be pushed up through a pair of apertures cut in the web of the first member 20 pushing the detents 30 aside until they lock into the notches 32.

A center cut out 34 is made at the top end of the post 14 so that the end of the post 14 rests against the web of the first member 20 and acts as a positive stop. The two remaining portions of the top end of the post 14 fit in the pair of apertures cut in the web of the first member. Shoulders 36 are provided on the second member 24 and the ends of the remaining portions of the post 14 rest against the shoulders 36 to provide a second positive stop.

Figure 4:
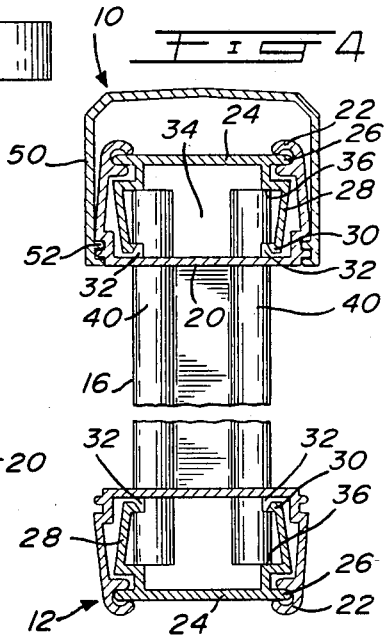
FIG. 4 is a cross sectional elevation taken at line 4—4 of FIG. 2.
Figure 5:
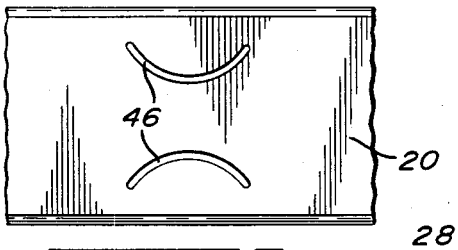
FIG. 5 is a partial view of the first member of a nail as shown in FIG. 4 illustrating a pair of slots for the flanges of a picket.
Figure 6:
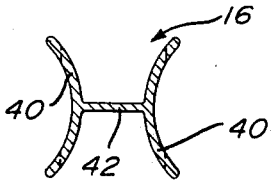
FIG. 6 is a top view of a picket suitable for the railing assembly of FIG. 1.
Figure 7:
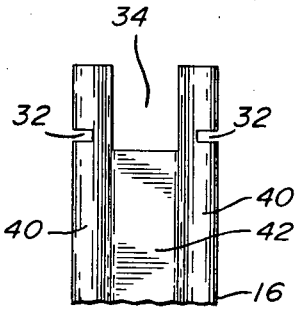
FIG. 7 is a side view of the picket shown in FIG. 6.
Figure 8:
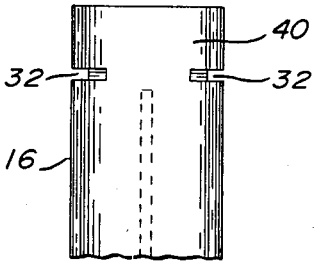
FIG. 8 is an end view of the picket shown in FIG. 6.

FIG. 4 illustrates the connection between the pickets 16, the top rail 10 and the bottom rail 12. The connection to both the top rail 10 an the bottom rail 12 are substantially the same. The shape of the picket 16, illustrated in FIG. 6 has a substantially H-shaped cross section with curved flanges 40 and a center straight web 42. As shown in FIGS. 6, 7 and 8, the web 42 has a cutout 34 at each end so that only the flanges 40 protrude into the top and bottom railing assembly. Furthermore, notches 32 are cut on the outside of the flanges 40 above the cut out 34 to engage with detents 30 on the ends of the flanges 28 of the second member 24. FIG. 5 illustrates a pair of slots 46 cut in the web of the first member 20 for insertion of the flanges 40 of the pickets 16.

To assemble the ends of the pickets 16 are inserted through the pair of slots 46 in the web of the first member 20, the detents 30 on the flexible flanges 28 of the second member 24 are forced aside until the picket 16 is pushed through the slots 46 so that the end of the flanges 40 of the picket 16 rest against shoulder 36 of the second member 24 and the web 42 of the picket at the cut out 34 rests against the web of the first member 20. This provides two positive stops and the detents 30 engage in the notches 32 of the picket ends to provide a snap lock. The result is a rigid connection between the pickets at the top rail 10 and bottom rail 12.

As illustrated in FIG. 4, a hand rail cover 50 fits over the top rail 10 and has a snap lock or sliding arrangement with grooves 52 fitting into the bottom edges of the first member 20.

Figure 9:
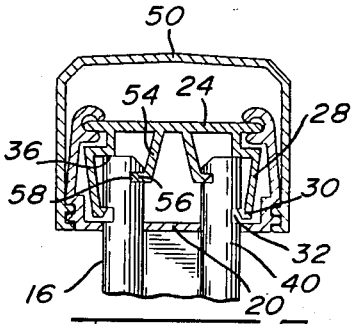
FIGS. 9, 10 and 11 are cross sectional elevations through the top rail showing different embodiments of snap lock connections between the picket and rail.
Figure 10:
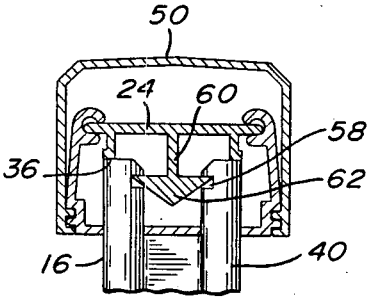
Figure 11:
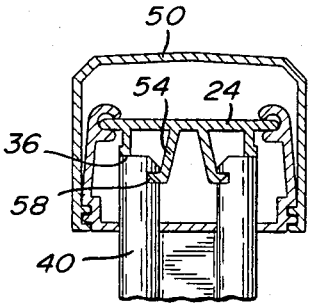

Other examples of the connection between the pickets 16 and the top rail 10 are illustrated in FIGS. 9, 10 and 11. Whereas only the top rail 10 is disclosed, it will be apparent to those skilled in the art that these connections would also be identical for the bottom rail 12. FIG. 9 illustrates a double snap lock connection wherein center flanges 54 protrude down from the web of the second member 24. The center flanges 54 have detents 56 at their end to engage in notches 58 provided on the inside of the flanges 40 in the cutout 34 at the top of the pickets 16. The tops of the flanges 40 have a bevelled surface as does the detents 56 to allow the flanges 54 to flex inwards when the picket 16 is pushed through the pair of slots 46 in the web of the first member 20. The arrangement illustrated in FIG. 9 provides a double snap lock connection.

FIG. 10 is another embodiment showing a single extension arm 60 extending from the web of the second member 24 with a triangular shape member 62 at the end thereof. The triangular shape member 62 is flexible so that the corners of the triangular shape member 62 flex as the end of the picket 16 is pushed through the pair of slots 46 in the first member 20 so that the ends of the triangular member 62 engage in the notches 58 provided on the inside of the flanges 40. FIG. 11 illustrates another embodiment similar to that shown in FIG. 9 except that the outer flanges 28 with detents 30 on the second member 24 are removed relying only on the notches 58 on the inside of the flanges 40 to engage and snap lock the end of the picket 16 to the rail.

Figure 12:
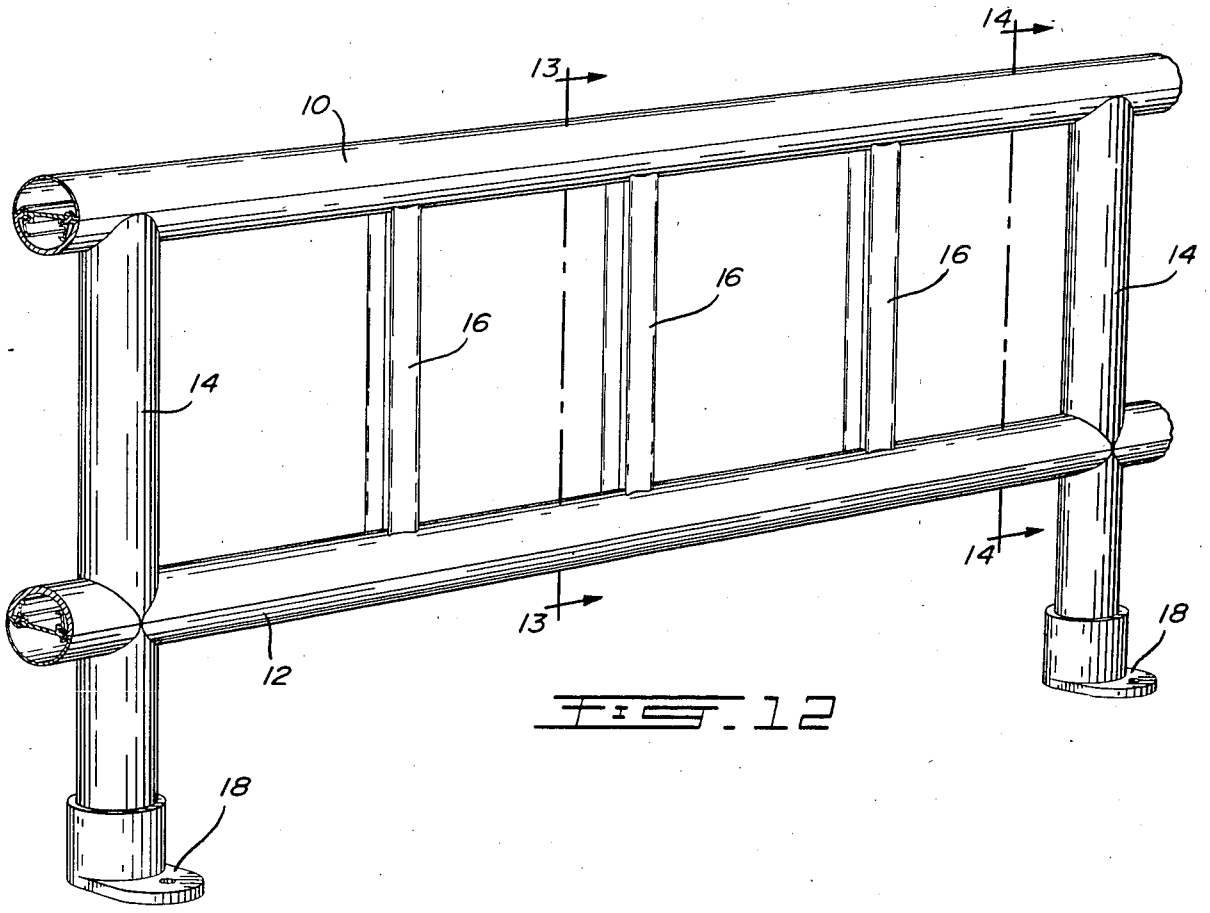
FIG. 12 is an isometric view of another embodiment of a hand railing assembly according to the present invention.
Figure 13:
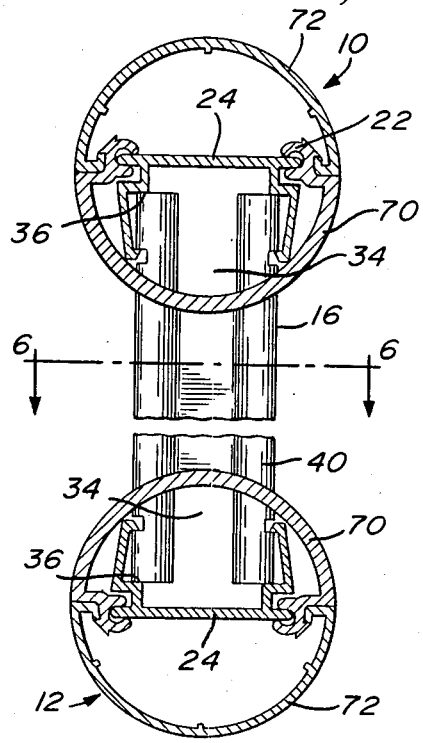
FIG. 13 is a cross sectional elevation taken at line 13—13 of FIG. 12.

Another embodiment of a hand railing assembly is shown in FIG. 12. The pickets 16 have the same cross section as that shown in FIG. 6. However, the top rail 10 and bottom rail 12 both have a circular cross section as shown in FIG. 13. The first member 70 has a semi-circular configuration with a pair of opposing grooves 22 substantially the same as the slots shown in the first member 20 of FIGS. 2 and 3. The second member 24 is substantially the same shape as that shown in FIG. 4 and engages the end of the pickets 16 in exactly the same manner as shown in FIG. 4. A pair of slots 46 as shown in FIG. 5 are cut in the semi-circular first member 70, and the web 42 of the picket 16 has a cutout 34 so that it rests against the outer surface of the first member 70 between the pair of slots 46. A top cover 72 is snap locked or slid onto the first member 70 to form a circular cross section. The top cover 72 is used in both the top rail 10 and bottom rail 12, thus providing both rails with a circular cross section throughout their length.

Figure 14:
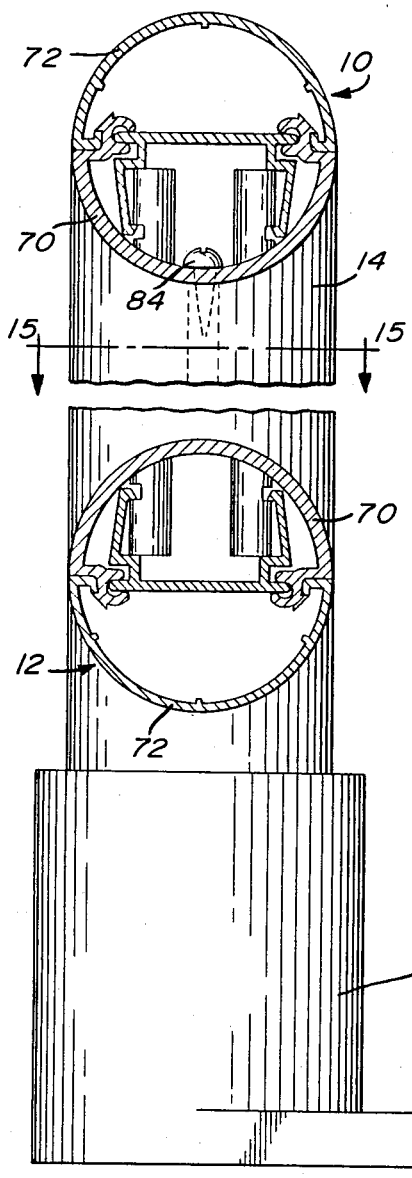
FIG. 14 is a cross sectional elevation taken at line 14—14 of FIG. 12.
Figure 15:
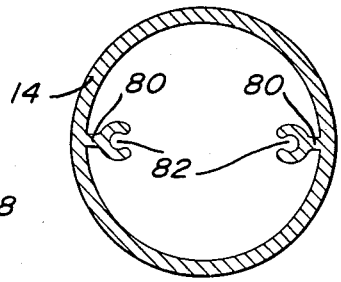
FIG. 15 is a cross section of the post taken at line 15—15 of FIG. 14.

As shown in FIGS. 14 and 15, the post 14 has a substantially round cross section the same size of the rails. The interior of the post 14 has two opposing protrusions 80 extending inwards towards each other. The protrusions 80 have grooves 82 for screw attachment between the top rail 10 and the post 14. FIG. 14 illustrates the connection between the post 14 and the top rail 10 wherein screws 84 pass through drilled holes in the first member 70. The top end of the post 14 has a semi-circular groove cut therein, so that it exactly matches the outside shape of the first member 70. The two screws 84 are then inserted through holes drilled in the first member 70 and engage the grooves 82 of the post 14. As far as the lower rail is concerned, semi circular grooves are cut in the combined first member and top cover 72 so that the post 14 passes what appears to be through the bottom rail 12. The bottom rail 12 is supported between the pickets 16 and located by the posts 14.

Various changes may be made to the embodiments described herein without departing from the scope of the present invention which is limited only by the following claims.

The embodiments of the invention in which an exclusive property or privilege is claimed are defined as follows.

1. In a hand railing assembly with a top rail and a bottom rail secured in spaced apart parallel relationship by a plurality of spaced apart vertical pickets, the railing assembly being supported by a plurality of spaced apart vertical posts connected to the top rail, the improvement comprising each of the vertical pickets having a substantially H-shaped cross section with curved flanges and a center web, the top and bottom rails each having a first member and a second member, the first member extending for the length of the railing assembly and having pairs of slots spaced apart along the length, the pairs of slots holding the flanges at the end of the pickets, the second member positioned in opposing grooves in the first member having a snap lock connection to notches located in the flanges at the ends of the pickets, and a first positive stop for the end of each of the flanges, the web of each of the pickets being cut out at the ends of the pickets to provide a second positive stop with the first member between slots in each of the pairs of slots.

2. The railing assembly according to claim 1 including a cover member on the top rail, snap locked to the first member.

3. The railing assembly according to claim 1 wherein the snap lock connection comprises two flexible flanges with detents to engage in the notches located on the outside of the two flanges.

4. The railing assembly according to claim 1 wherein the snap lock connection comprises two flexible flanges with detents to engage in the notches located on the inside of the two flanges.

5. The railing assembly according to claim 1 wherein the snap lock connection comprises a flexible member with two detents to engage in the notches located on the inside of the two flanges.

6. The railing assembly according to claim 1 wherein the vertical posts have a snap lock connection to the top rail substantially similar to the connection between the vertical pickets and the top and bottom rail.

7. The railing assembly according to claim 1 including a cover member snap locked to the first member of the top and bottom rail, the cover member and first member together having a circular cross section.

8. The railing assembly according to claim 7 wherein the vertical posts having a circular cross section substantially the same size as the top and bottom rail.

* * * * *